US010354626B1

(12) United States Patent
Lucas

(10) Patent No.: US 10,354,626 B1
(45) Date of Patent: Jul. 16, 2019

(54) SWIVELING STRAP EXTENSION DEVICE AND METHOD OF USE

(71) Applicant: Richard C. Lucas, Ashland, OR (US)

(72) Inventor: Richard C. Lucas, Ashland, OR (US)

( * ) Notice: Subject to any disclaimer, the term of this patent is extended or adjusted under 35 U.S.C. 154(b) by 0 days.

(21) Appl. No.: 15/957,620

(22) Filed: Apr. 19, 2018

Related U.S. Application Data

(60) Provisional application No. 62/603,191, filed on May 22, 2017.

(51) Int. Cl.
*G10G 5/00* (2006.01)
*G10D 1/08* (2006.01)

(52) U.S. Cl.
CPC ..... *G10G 5/005* (2013.01); *G10D 1/08* (2013.01)

(58) Field of Classification Search
CPC ..... G10G 5/005; G10D 1/08
USPC ..... 84/327
See application file for complete search history.

(56) References Cited

U.S. PATENT DOCUMENTS 3,037,416 A * 6/1962 Cunningham ..... G10G 5/005 224/269
3,894,464 A * 7/1975 Brooks ..... G10G 5/005 224/257
4,014,240 A * 3/1977 Pullen ..... G10G 5/005 224/910
4,144,794 A * 3/1979 Silverman ..... G10G 5/005 224/257
4,274,181 A * 6/1981 Schaller ..... G10G 5/005 224/257
4,291,822 A * 9/1981 Simonds ..... G10D 1/08 224/257
4,715,259 A * 12/1987 Wittman ..... G10D 3/00 224/910
4,993,127 A * 2/1991 Mechem ..... A45C 13/30 224/257
5,069,103 A * 12/1991 Healy ..... G10G 5/005 224/910
5,372,346 A * 12/1994 Upchurch ..... F16B 21/04 248/222.52
5,503,315 A * 4/1996 Ruzika ..... G10G 5/00 224/257
6,080,922 A * 6/2000 Dimbath ..... G10G 5/005 84/327

(Continued)

*Primary Examiner* — David S Warren
*Assistant Examiner* — Christina M Schreiber
(74) *Attorney, Agent, or Firm* — Jerry Haynes Law

(57) ABSTRACT

A swiveling strap extension device and method of use is operable with an instrument strap. The extension device comprises a flat, elongated longitudinal member having an instrument end that attaches to an instrument. The instrument end has size-adjustable eyelets that fasten to the instrument at mount buttons. The swivel end has a terminus section and a body section. The terminus section attaches to a free end of the instrument strap. A swivel-coupling connects the terminus and body sections. The swivel coupling swivels up to 360°, allowing the terminus section to rotate correspondingly. The swivel-coupling is disposed at a fixed length from the instrument. The fixed length is defined as the distance from the eyelets to the terminus section of the swivel end. The fixed length enables the swivel-coupling to be disposed approximately in an open space that forms between the instrument and the back of an instrument operator.

17 Claims, 6 Drawing Sheets

(56) References Cited

U.S. PATENT DOCUMENTS

| | | | | |
|---|---|---|---|---|
| 6,202,262 | B1 * | 3/2001 | Hamburger, III | A44B 11/226 224/257 |
| 6,581,812 | B2 * | 6/2003 | Roscoe-Dare | A45F 3/14 224/257 |
| 7,470,842 | B2 * | 12/2008 | Miller | G10G 5/005 84/329 |
| 8,618,393 | B1 * | 12/2013 | Peters | G10G 5/005 84/327 |
| 9,257,110 | B1 * | 2/2016 | Smith | G10G 5/005 |
| 9,530,393 | B1 * | 12/2016 | Corcorran | G10D 3/163 |
| D831,105 | S * | 10/2018 | Lucas | D17/20 |
| 2008/0202313 | A1 * | 8/2008 | Ruel | G10G 5/005 84/327 |
| 2009/0283561 | A1 * | 11/2009 | Zamora | A45F 3/12 224/264 |

* cited by examiner

SWIVELING STRAP EXTENSION DEVICE AND METHOD OF USE

CROSS-REFERENCE TO RELATED APPLICATIONS

This application claims the benefits of U.S. provisional application No. 62/603,191, filed May 22, 2017 and entitled VERSATILE STRAP ADAPTOR, which provisional application is incorporated by reference herein in its entirety.

FIELD OF THE INVENTION

The present invention relates generally to a swiveling strap extension device and method of use. More so, the present invention relates to a strap extension device operable with an instrument strap to extend and adjust the length of the instrument strap, freely swivel to counteract twisting by the instrument strap, and self-correct excessive twisting by the instrument strap through use of a swivel-coupling that swivels up to 360°, and is disposed at a fixed length from the instrument, approximately in an open space that forms between the instrument and the body of an instrument operator, so as to optimize free swiveling by the swivel-coupling with minimal obstructions, or abrasive contact between the swivel-coupling and the instrument.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically during the playing of an instrument, such as a guitar, the instrument is supported by a strap that is looped over one shoulder and attached at one end to a bottom central location on the guitar body and at an opposite end adjacent either the guitar neck's heel or head. Further, in the case of a number of musical instruments, such as guitars, string basses, banjos, mandolins, marching drums and brass instruments it is common practice to attach to the instrument a strap which passes around the neck or over the shoulder of the player to aid in holding the instrument in a playing position.

Even when the instrument strap is used, the instrument operator requires a fair degree of freedom in moving the instrument relative to the body however. Thus, it is often preferred that the instrument strap be connected to the instrument in such a way as to allow for pivotal or swiveling movement between the strap and the instrument. It is also usually preferred that the strap be capable of being easily and quickly connected and disconnected from the instrument so as to facilitate the operator's taking up and putting down of the instrument and of his switching from one instrument to another.

Such transfers and movement by the instrument operator and instrument can cause the instrument strap to twist, bind, and even spiral. This spiraling by the instrument strap occurs because the strap flips over due to the strap's eye rotating 360° around the instrument mounting button, which then causes the instrument strap to curl into a complete spiral twist. This is a common occurrence which is often not noticed until the instrument is shouldered for playing. At that point, however, it becomes difficult for the operator to untwist the instrument strap, or even know which direction to untwist. Potentially, the operator can create more twisting and binding, unless the instrument strap is un-shouldered and carefully untwisted. This can delay or spoil a performance.

Other proposals have involved countering slight twisting by an instrument strap. The problem with these instrument strap devices and methods is that they do not include the option of extending or adjusting the length of the instrument strap, or counter twisting and "flip over" by the instrument strap, and they are unable to self-correct excessive twisting by the instrument strap. Even though the above cited instrument strap devices and methods meet some of the needs of the market, a "swiveling strap extension device and method of use" is operable with an instrument strap to extend and adjust the length of the instrument strap, counteract twisting by the instrument strap, and self-correct excessive twisting by the instrument strap through use of a swivel-coupling that swivels up to 360°, and is disposed at a fixed length from the instrument, approximately in an open space that forms between the instrument and the body of an instrument operator, is a desired advantage.

SUMMARY

Illustrative embodiments of the disclosure are generally directed to a swiveling strap extension device and method of use. The strap extension device is operable with an instrument strap to extend and adjust the length and positioning of the instrument strap, freely swivel to counteract twisting by the instrument strap, and self-correct excessive twisting by the instrument strap through use of a swivel-coupling that swivels up to 360°, and is disposed at a fixed length from the instrument, approximately within an open space that forms between the instrument and the body of an instrument operator, so as to optimize free swiveling by the swivel-coupling with minimal obstructions, or abrasive contact between the swivel-coupling and the instrument.

In some embodiments, the strap extension device may include a flat, elongated longitudinal member having an instrument end and an oppositely disposed swivel end. The instrument end attaches to an instrument. The instrument end has size-adjustable eyelets that fasten to the instrument mount buttons, or other anchoring structure on the instrument. The eyelets are pliable, and may expand in diameter, and thereby accommodate variously sized and dimensioned instrument mount buttons.

The swivel end has a terminus section and a body section. A swivel-coupling connects the terminus and body sections. The swivel coupling swivels up to 360°, allowing the terminus section to rotate correspondingly. The body section and instrument end of the longitudinal member normally remains relatively stationary, not twisting with the terminus section or the instrument strap.

In one embodiment, the swivel-coupling is disposed at a fixed length from the instrument. The fixed length is defined as the distance from the eyelets at the instrument end to the terminus section of the swivel end. The fixed length enables the swivel-coupling to position and swivel, approximately in an open space that forms between the instrument and the body of an instrument operator. This creates a free space for the swivel-coupling to rotate freely in counteraction to twisting by the instrument strap.

In one embodiment, the instrument strap is defined by a coupled end and a free end. The coupled end is coupled to the instrument. The free end of the instrument strap is detachably attachable to the terminus section of the longitudinal member. The terminus section rotates to counteract twisting by the instrument strap. The body section and instrument end of the longitudinal member can remain stationary, not twisting with the terminus section or the instrument strap.

In another aspect, the fixed length from the instrument by the swivel-coupling is approximately in an open space that forms between the instrument and the body of an instrument operator while playing the instrument.

In another aspect, the terminus section of the swivel end is adapted to rotate up to 360°, while the body section of the swivel end and the instrument end remains substantially stationary.

In another aspect, the swivel-coupling comprises a cylinder that receives a shaft in a rotational relationship.

In another aspect, the swivel-coupling comprises a pair of spaced-apart, parallel brackets rotatably joined by at least one bolt.

In yet another aspect, the eyelets are shaped as a circle with an adjacent elongated slot.

In yet another aspect, the longitudinal member is fabricated from at least one of the following: leather, nylon, cotton, rubber, polyurethane, polyvinylchloride, and a resilient polymer.

In yet another aspect, the terminus section of the swivel end of the longitudinal member comprises a button.

In yet another aspect, the terminus section of the swivel end of the longitudinal member is defined by a hole.

In yet another aspect, the instrument may include, without limitation, a guitar, an electric guitar, a string bass, a banjo, a mandolin, a marching drum, a brass instrument, a firearm, and a hand-held equipment.

In yet another aspect, the device further comprises a belt clip attached to the longitudinal member.

In yet another aspect, the device further comprises a lanyard, the lanyard connecting the free end of the instrument strap to a mounting point on a section of strap near the coupled end.

In yet another aspect, a lanyard detachably attaches to a belt or loop worn by the instrument operator.

One objective of the present invention is to enable an instrument strap to resist twisting, and self-correct to a non-twisted position while being used.

Another objective is to position the swivel-coupling at a spaced-apart distance from the instrument—generally in the open space between the instrument and the body of the instrument operator.

Yet another objective is to position the extension across the face of the instrument, so as to pull the instrument closer to the operator and still create free space for swiveling action.

Yet another objective is to prevent rubbing of the swivel-coupling against the instrument or the instrument operator.

Yet another objective is to prevent vibration by the swivel-coupling by positioning it away from the instrument.

Yet another objective is to attach the swivel end of the extension device with a belt.

Yet another objective is to make the extension device manufactured integrally with the instrument strap.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
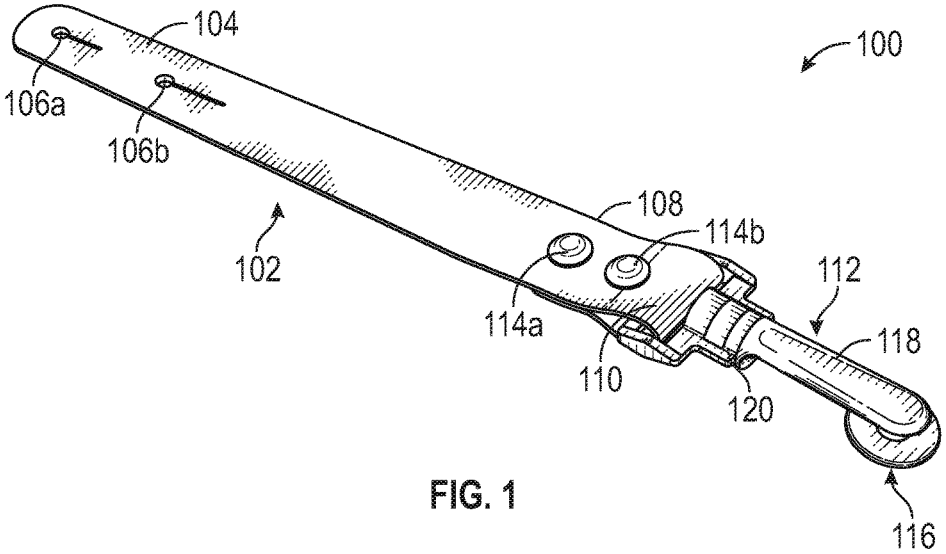
FIG. 1 illustrates a perspective view of an exemplary swiveling strap extension device, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A swiveling strap extension device 100 and method of use is referenced in FIGS. 1-8. The strap extension device 100, hereafter "device 100" is configured to simultaneously attach to both an instrument 500 and an accompanying instrument strap 502. The device 100 extends the length of the instrument strap 502 through use of a longitudinal member 102. The device 100 is configured to swivel, so as to counter excessive twisting and "flip over" by the instrument strap 502. The device 100 swivels through use of a swivel-coupling 116 that is adjustably positionable at a fixed length 512 from the instrument 500, approximately in an open space 514 that forms between the instrument 500 and the body 508 of an instrument operator 506. The unique position of the swivel-coupling 116 in relation to the instrument 500 optimizes free swiveling by the swivel-coupling 116 with minimal obstructions, or abrasive contact between the longitudinal member 102, swivel-coupling 116, and instrument 500.

In some embodiments, the instrument strap 502 may include, without limitation, a strap that is looped over one shoulder and attached from a coupled end 504*a* to a bottom central location on the guitar body, and from a free end 504*b* to the guitar neck. In other embodiments, the instrument 500 may include, without limitation, a guitar, an electric guitar, a string bass, a banjo, a mandolin, and generally any string instrument. In yet other embodiments, the instrument 500 may include a marching drum, a brass instrument, a firearm, and a hand-held equipment that benefits from use of a shoulder strap.

As referenced in FIG. 1, the device 100 comprises a longitudinal member 102. In some embodiments, the longitudinal member 102 may connect from opposite ends to an instrument 500 and an instrument strap 502; thereby extending the length of the instrument strap 502 and stabilizing the instrument 500 during operation (playing). In some embodiments, the longitudinal member 102 may be flat, elongated, and flexible, so as to enable free movement of the connected instrument 500 and instrument strap 502.

Figure 5:
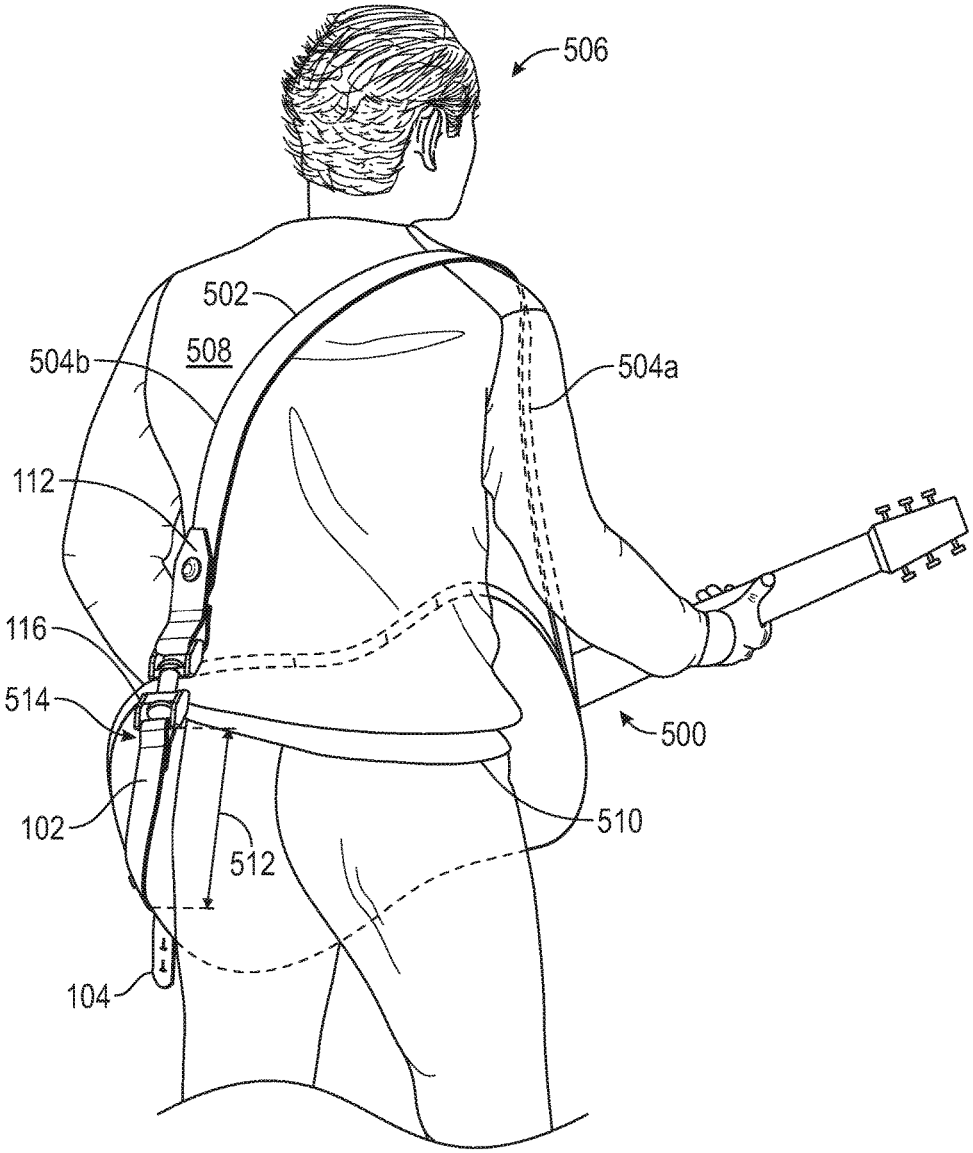
FIG. 5 illustrates a perspective view of an instrument operator playing an instrument with a swivel-coupling at a fixed length from the instrument, in accordance with an embodiment of the present invention.

In some embodiments, the longitudinal member 102 may have characteristics that are substantially the same as the attached instrument strap 502. In other embodiments, the longitudinal member 102 is a unitary piece that is segregated into different sections that perform different functions. In one non-limiting embodiment, a substantial portion of the longitudinal member 102 comprises a generally flat, elongated, and resilient belt/strap that is similar in shape and size to the instrument strap 502 (FIG. 5). Suitable materials for the longitudinal member 102 may include, without limitation, leather, nylon, cotton, rubber, polyurethane, polyvinylchloride, and a resilient polymer.

Figure 2:
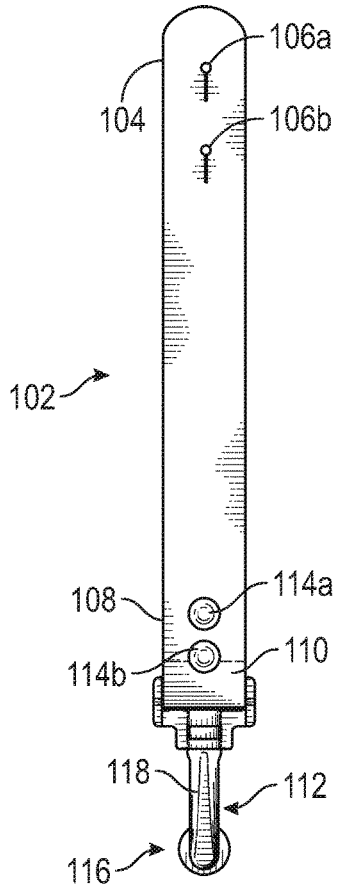
FIG. 2 illustrates a top view of a first side of the swiveling strap extension device shown in FIG. 1, in accordance with an embodiment of the present invention.

Looking now at FIG. 2, the longitudinal member 102 comprises an instrument end 104 and an oppositely disposed swivel end 108. In one embodiment, the instrument end 104 of the longitudinal member 102 detachably attaches to an instrument 500. And the swivel end 108 attaches to a free end 504*b* of the instrument strap 502.

The instrument end 104 of the longitudinal member 102 is defined by multiple spaced-apart, size-adjustable eyelets 106*a*, 106*b* that enable passage of a fastener for detachable attachment to the instrument 500. The eyelets 106*a-b* provide for quick and easy connection and disconnection of the instrument end 104 of the longitudinal member 102 to and from a musical instrument 500 or other body. For example, a screw or rod passes through a selected eyelet and into an instrument mount button or hole to fasten the instrument end 104 of the longitudinal member 102 to the instrument 500.

In some embodiments, the eyelets 106*a-b* are sufficiently pliable to increase in diameter; and thereby accommodate variously sized and dimensioned instrument 500 coupling buttons from the instrument 500. This allows for facilitated attachment to different types and sizes of instruments. In one non-limiting embodiment, the eyelets 106*a-b* are shaped as a circle with an adjacent elongated slot. Though the eyelets 106*a-b* may have other shapes and dimensions.

Figure 3:
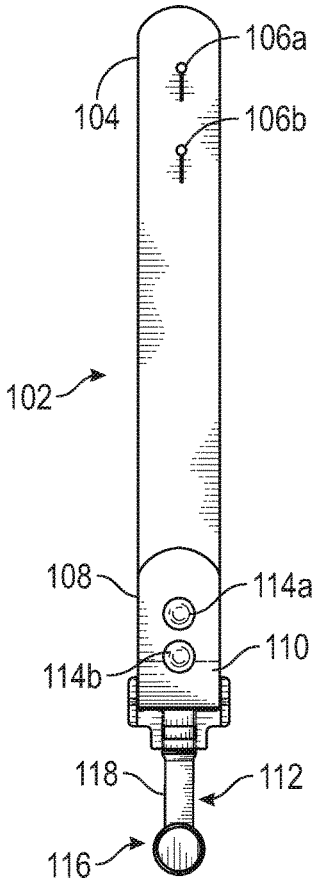
FIG. 3 illustrates a top view of a second side of the swiveling strap extension device shown in FIG. 1, in accordance with an embodiment of the present invention.
Figure 4:
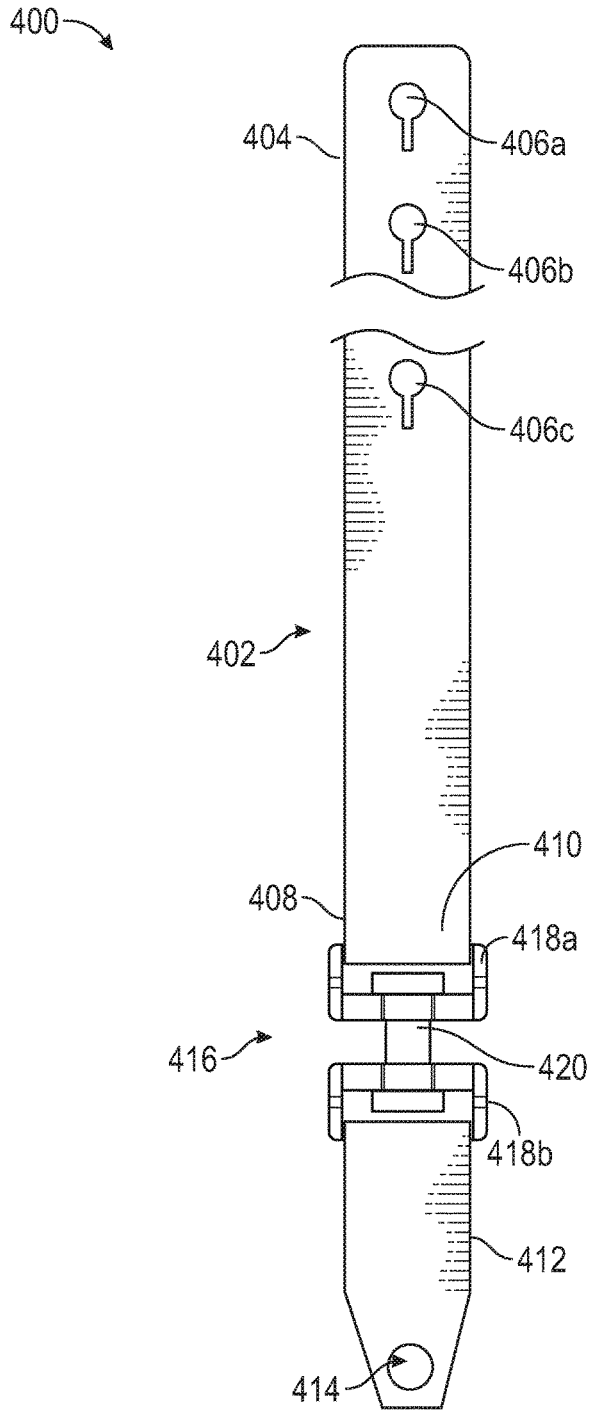
FIG. 4 illustrates a top view of an alternative embodiment of a swiveling strap extension device, in accordance with an embodiment of the present invention.

As shown in FIG. 3, the longitudinal member 102 also forms a swivel end 108. The swivel end 108 has a terminus section 112 and a body section 110. The body section 110 is proximally positioned to the instrument end 104 of the longitudinal member 102, while the terminus section 112 is more distally disposed thereto. The terminus section 112 may include a continuation of the shape and material composition of the longitudinal member 102, such as a continuous flat belt (FIG. 4). Though in other embodiments, the terminus section 112 is a separate material and dimension than the longitudinal member 102, such as the elongated bracket shown in FIGS. 1-3.

The terminus section 112 of the swivel end 108 attaches to the free end 504*b* of the instrument strap 502. The terminus section 112 of the swivel end 108 may include at least one button 114*a*, 114*b* for fastening to the free end 504*b* of the instrument strap 502. The button 114*a-b* may include a snap button that fastens a folded over piece of the swivel end 108. Though in other embodiments, the terminus section 112 is defined by a hole 414 for fastening to the free end 504*b* of the instrument strap 502 (FIG. 4). In either configuration, the attachment to the free end 504*b* of the instrument strap 502 is quick and requires no tools or special skill set.

Looking again at FIG. 1, the device 100 provides a swivel-coupling 116 that connects the body and terminus sections 110, 112. The swivel-coupling 116 is configured to swivel up to 360°, causing the attached terminus section 112 to rotate correspondingly. The body section 110 and instrument end 104 of the longitudinal member 102, which are proximally anchored to the instrument 500, remain stationary, however, not twisting with the terminus section 112 and instrument strap 502.

In one embodiment, the swivel-coupling 116 comprises a cylinder 120 that receives a shaft 118 in a rotational relationship. The shaft 118 rotates up to 360° inside the cylinder 120, carrying the terminus section 112 in this rotational movement. Though in other embodiments, the swivel-coupling 416 comprises a pair of brackets 418*a*, 418*b* that are rotatably joined by at least one bolt 420 (FIG. 4). The brackets 418*a-b* rotate about the bolt 420. In yet other embodiments, any coupling mechanism that enables rotational articulation by the terminus section 112 may be used.

Thus, a twisting motion by the instrument strap 502 (a resultant from conveying or playing the instrument) causes the terminus section 112 of the swivel end 108 to rotate correspondingly up to 360°, while the body section 110 of the swivel end 108 and the instrument end 104 of the longitudinal member 102 remain substantially stationary. The instrument end 104 of the longitudinal member 102 maintains this stationary mode as a result of the attachment to the instrument 500, which generally does not twist like the instrument strap 502 does.

Looking now at FIG. 5, the swivel-coupling 116 is disposed at a fixed length 512 from the instrument 500. The fixed length 512 is defined as the distance from the eyelets 106*a-b* to the terminus section 112 of the swivel end 108. The fixed length 512 positions the swivel-coupling 116 approximately in an open space 514 that forms between the instrument 500 and the body 508 of an instrument operator 506 who operates the instrument 500. This unique positioning of the swivel-coupling 116 creates a free space for the swivel-coupling 116 to rotate freely in counteraction to twisting by the instrument strap 502. In some embodiments, the fixed length 512 of the swivel-coupling 116 can, however, be adjustably repositioned in relation to the instrument 500. The free space is effective for enabling free swiveling by the swivel-coupling 116 with minimal obstructions, or abrasive contact between the longitudinal member 102, swivel-coupling 116, and instrument 500.

Thus, by positioning the swivel-coupling 116 to the instrument strap 502 in the open space 514 that forms between the instrument 500 and the body 508 of an instrument operator 506, and at the fixed length 512 from the instrument 500, the swivel-coupling 116 has more free space to swivel in counteraction to twisting by the instrument strap 502. This helps prevent undesirable twisting by the instrument strap 502, as the swivel-coupling 116 self-corrects excessive twisting by the instrument strap 502.

Figure 8:
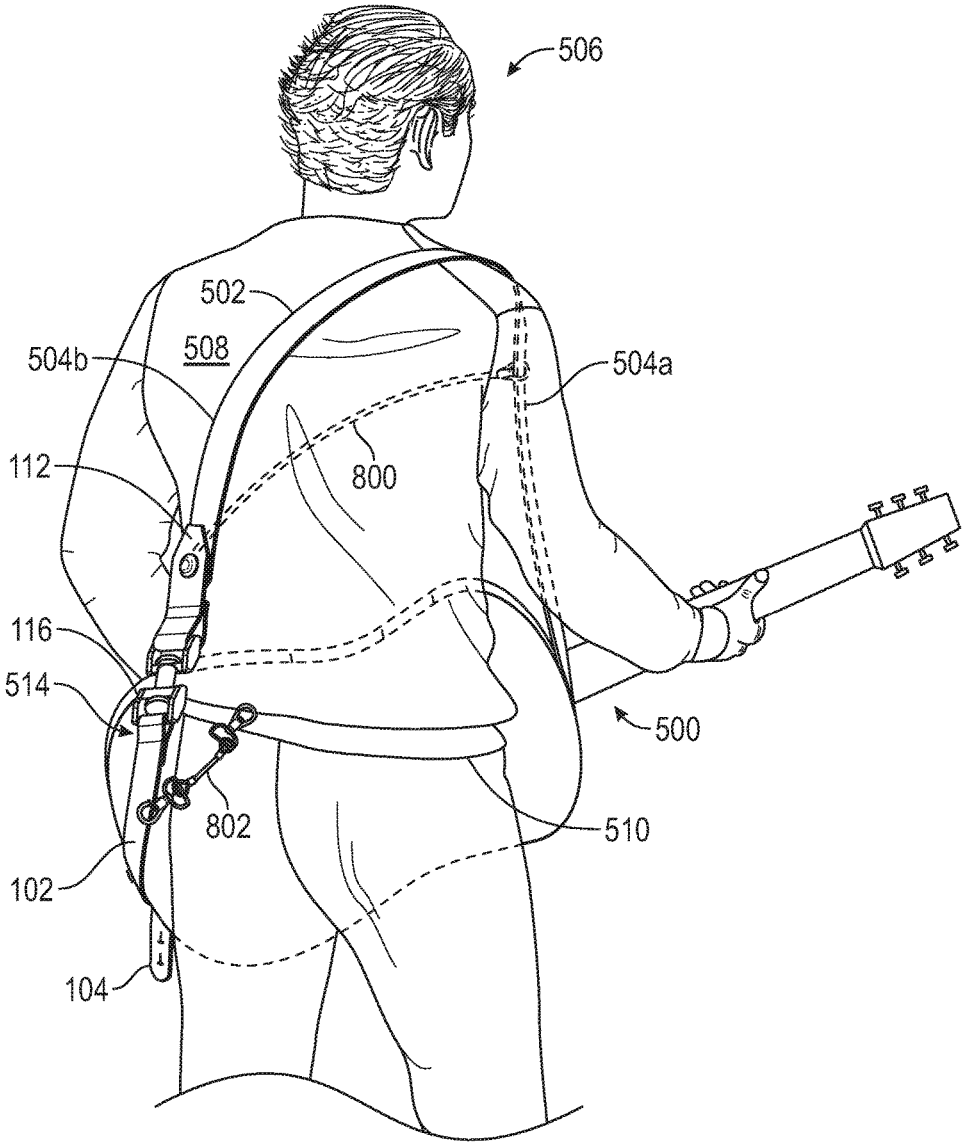
FIG. 8 illustrates a perspective view of an instrument operator playing an instrument with a lanyard and a belt clip used to enhance stability of the longitudinal member and maintain the instrument closer to the body of the instrument operator, in accordance with an embodiment of the present invention.

Further, the distal positioning of the swivel-coupling 116 in relation to the instrument 500 prevents abrasive engagement with the instrument 500 or the instrument operator 506. In one alternative embodiment, a lanyard 800 may also be employed to span between the free end 504*b* of the instrument strap 502, to a mounting point on strap section 504*a* for added stability (FIG. 8).

Thus, when the instrument strap 502 twists during conveying or playing of the instrument 500, the swivel-coupling 116 can correspondingly swivel up to 360°. This causes the terminus section 112 to rotate up to 360°, while the body section 110 and the instrument end 104 of the longitudinal member 102 remain substantially stationary, straight, and generally untwisted. Consequently, there is no twisting or strap "flip over" at or near the instrument end 104 of the longitudinal member 102, including at the connection between the eyelets 106*a*, 106*b* and the instrument mount buttons, where the eyelets 106*a-b* are fastened to the instrument 500. If accidental twisting should occur however, the swivel will still allow the strap to self-correct.

Figure 6:
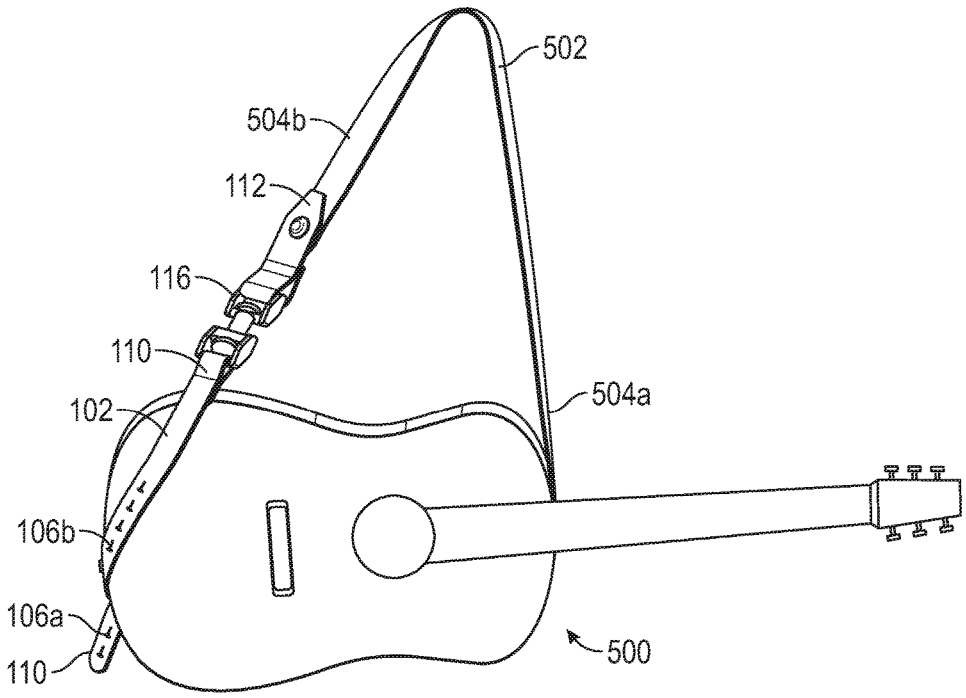
FIG. 6 illustrates a perspective view of a swiveling strap extension device attached to the instrument strap, showing the strap extension and swivel in front of and above the instrument, in accordance with an embodiment of the present invention.

As FIG. 6 shows, another possible position for the strap extension 102 is, however, across the face of the instrument 500. Here, the swivel-coupling 116 is still positioned in the open space 514, and at a fixed length 512 from the instrument 500, as discussed above. But rather, towards the upper front side of the instrument 500. This frontal positioning can be desirable when the instrument 500 is a guitar, and the instrument operator 506 requires the guitar to be closer while playing, and/or aligning the face of the guitar. For example, when playing acoustic guitars, which are known in the art to tip out away from the instrument operator 506.

Turning back to FIG. 4, an alternative embodiment of a swiveling strap extension device 400 is possible. The alternative device 400 is substantially the same as the above mentioned device 100, except that the terminus section 412 and the swivel-coupling 416 are configured differently. The alternative device 400 comprises a longitudinal member 402 having an instrument end 404 having multiple eyelets 406*a*, 406*b*, 406*c*, and an opposite swivel end 408. The swivel end 408 comprises a body section 410 and a terminus section 412 defined by a hole 414 for fastening to a free end 504*b* of the instrument strap 502. A fastening mechanism, such as a bolt, button, or clip may be used to pass through the hole 414 for fastening to the instrument strap 502.

Similar to the above swiveling strap extension device 100, the alternative device 400 also provides a swivel-coupling 416 that is disposed between the terminus section 412 and the body section 410 of the swivel end 408. The swivel-coupling 416 is operable to swivel up to 360°, allowing the terminus section 412 to rotate up to 360° in correlation with the swivel-coupling 416. The swivel-coupling 416 comprises a pair of brackets 418*a*, 418*b* that are rotatably joined by at least one bolt 420. The brackets 418*a-b*, and thus the terminus section 412 rotate about the bolt 420, so as to counter twisting by the instrument strap 502. Nonetheless, the alternative device 400 provides a terminus section 412 forming a hole 414, and a swivel-coupling 416 with brackets and bolts 418*a-b*, 420 that operate substantially the same as the terminus section 112 and swivel-coupling 116 described above.

Figure 7:
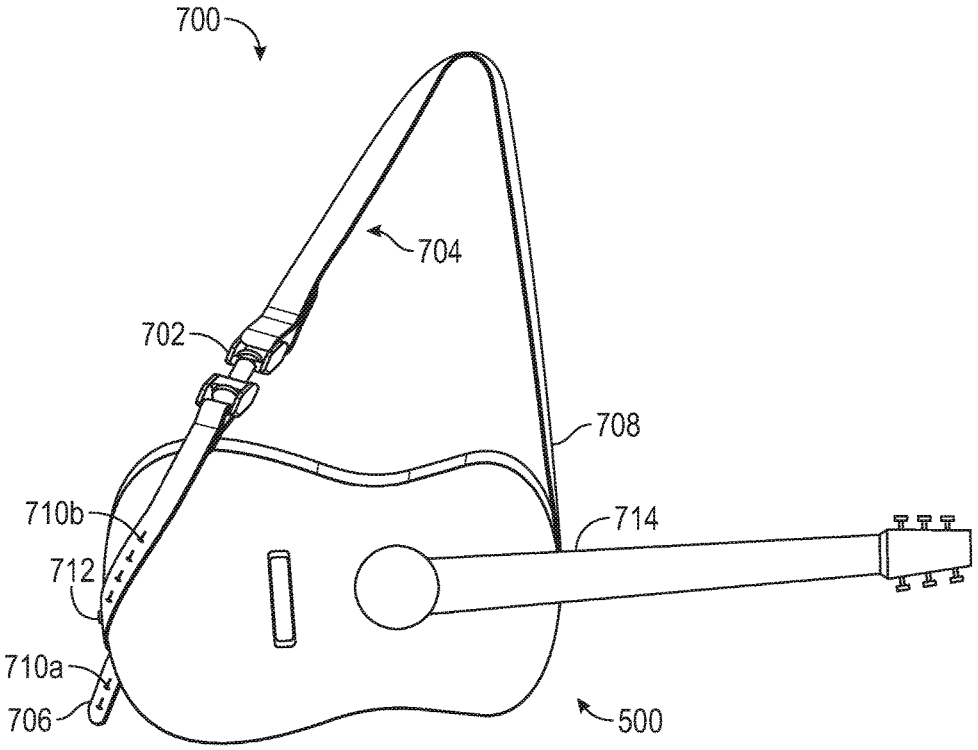
FIG. 7 illustrates a perspective view of a swiveling strap device integral with the instrument strap, in accordance with an embodiment of the present invention.

In yet another alternative embodiment shown in FIG. 7, a swiveling strap device 700 is integral with the instrument strap 502. In this embodiment, the swiveling strap device 700 is not an extension to the instrument strap 502, but rather, operates as the instrument strap. The twisting and flipping that can occur with normal operation of the instrument 500 is countered with an integral swivel-coupling 702. The integral swivel-coupling 702 swivels up to 360°, substantially the same as the swivel-coupling 116 described above. But rather than carrying a terminus section 112, an entire swivel end 408 of a longitudinal member 402 rotates, while an instrument end 706 remains substantially stationary.

In this alternative embodiment 700, a longitudinal member 704 has an instrument end 706 and a swivel end 708. The instrument end 706 is defined by multiple spaced-apart eyelets 710*a*, 710*b*. At least one of the eyelets 710*a* is coupled to a first end 712 of the instrument 500. The swivel end 708 of the longitudinal member 704 is attached to a second end 714 of the instrument 500. The integral swivel-coupling 702 is disposed between the instrument end 706 and the swivel end 708. The integral swivel-coupling 702 is operable to swivel up to 360°. Thus, the swivel end 708 may rotate up to 360° while the instrument end 706 of the longitudinal member 704 that is anchored to the first end 712 of the instrument 500 remains substantially stationary—resistant to twisting.

Similar to the above described swivel-coupling 116, the integral swivel-coupling 702 is disposed at a fixed length 512 from the instrument 500. The fixed length 512 is defined as the length from the eyelets 710*a-b* to the swivel end 708. In this manner, the fixed length 512 positions the integral swivel-coupling 702 in the open space 514 that forms between the instrument 500 and the body 508 of the instrument operator 506.

As discussed above, the terminus section 112 of the swivel end 108 rotates to counter twisting by the instrument strap 502, while the body section 110 of the swivel end 108 and the instrument end 104 of the longitudinal member 102 remain stationary. This is partially because the instrument end 104 is attached to the instrument 500, which acts as an anchor to inhibit rotation. There are, however, other stabilizing components that help stabilize the body section 110 and the instrument end 104 of the longitudinal member 102 while the terminus section 112 rotates. If, through some unintended action the instrument end should rotate or become twisted, the pivot can still self-correct in the same manner.

FIG. 8 shows a lanyard 800 that forms a stabilizing nexus between the free end 504*b* of the instrument strap 502, to a mounting point on strap section 504*a*. The lanyard 800 provides additional stability to instrument strap 502, between 504*b* and 504*a*. In yet other embodiments, the device 100 further comprises a belt clip 802 that attaches to the longitudinal member 102. The belt clip 802 detachably attaches to a belt 510 worn by the instrument operator 506. This can be helpful to maintain the instrument position in relation to the instrument operator while operating the instrument.

In use, as shown in FIG. 5, an instrument operator 506 attaches a free end 504*b* of the instrument strap 502 to the terminus section 112 of the swivel end 108 of the longitudinal member 102. The instrument operator 506 also attaches, through us of the eyelets 106*a-b*, the instrument end 104 of the longitudinal member 102 to mount buttons, or other anchoring structures on the instrument 500. The eyelets 106*a-b* are pliable, and may be stretched to accommodate larger mount buttons or the other mounting structures.

The instrument operator 506 may then loop the instrument strap 502 over one shoulder, with the instrument end 104 of the longitudinal member 102 being attached to a bottom central location on the instrument first end 712 (guitar body), and a coupled end 504*a* of the instrument strap 502 attaches to the instrument second end 714 (at either the guitar neck's heel or head).

Next, the instrument strap 502 is length-adjusted to position the swivel-coupling 116 and length-adjusted at a fixed length 512 from the instrument; with the fixed length 512 being defined as the distance from the eyelets 106*a-b* to the terminus section 112 of the swivel end 108 of the longitudinal member 102. The instrument strap 502 is now in a position to aid in holding the instrument 500 for operation, such as to play a guitar, for example. The instrument operator 506 is now in a position to operate (play) the instrument 500.

As the instrument operator 506 conveys and begins operating the instrument 500, the instrument strap 502 may inadvertently twist, bind, or flip over. The instrument strap 502 also has a tendency to ride across the shoulder of the instrument operator 506 during operation of the instrument 500. While the instrument strap 502 twists in this manner, the swivel-coupling 116 swivels up to 360°, carrying the terminus section 112 through the rotational motion. It is significant to note that the swivel-coupling 116 positions in an open space 514 between the instrument 500 and the back 508 of the instrument operator 506. This allows for greater freedom of movement, and prevents abrasive rubbing against the instrument 500 or the instrument operator 506.

This free rotation by the swivel-coupling 116 allows the terminus section 112 to rotate in conjunction with the twisting motion of the instrument strap 502. The body section 110 and the instrument end 104 of the longitudinal member 102, being anchored to the instrument 500, do not readily twist with the terminus section 112 however. The instrument operator 506 may also attach a lanyard 800 between the free end 504*b* of the instrument strap 502 and to a mounting point on strap section 504*a* to increase stability. The instrument operator 506 may also attach a belt clip 802 to the longitudinal member 102 for clipping to the belt 510, if desired to maintain the instrument 500 position close to the body.

When the instrument operator 506 has concluded operating the instrument 500, the swiveling strap extension device 100 may be easily detached from the instrument strap 502 by removing the eyelets 106*a-b* from the mount button, and the button 114 or hole 414 from the free end 504*b* of the instrument strap 502, or by detaching from the instrument's other mounting point 714.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A swiveling strap extension device, the device comprising:

a longitudinal member comprising an instrument end and a swivel end, the instrument end defined by multiple spaced-apart eyelets, the eyelets being pliable, the swivel end having a terminus section and a body section, the body section being more proximal to the eyelets than the terminus section;

a belt clip detachably attached to the longitudinal member;

a swivel-coupling disposed between the terminus section and the body section of the swivel end, the swivel-coupling operable to swivel up to 360 degrees, whereby the terminus section of the swivel end is operable to rotate up to 360 degrees in correlation with the swivel-coupling; and an instrument strap defined by a coupled end and a free end, the coupled end being coupled to an instrument, the free end being detachably attachable to the terminus section of the swivel end of the longitudinal member.

2. The device of claim 1, wherein the terminus section of the swivel end is operable to rotate up to 360 degrees in correlation with the swivel-coupling, while the body section of the swivel end and the instrument end of the longitudinal member remain substantially stationary.

3. The device of claim 1, wherein the longitudinal member is fabricated from at least one of the following materials: leather, nylon, cotton, rubber, polyurethane, polyvinylchloride, and a resilient polymer.

4. The device of claim 1, wherein the swivel-coupling comprises a shaft rotatably housed in a cylinder.

5. The device of claim 4, wherein the terminus section of the swivel end of the longitudinal member comprises a button.

6. The device of claim 1, wherein the swivel-coupling comprises a pair of spaced-apart, parallel brackets rotatably joined by at least one bolt.

7. The device of claim 6, wherein the terminus section of the swivel end of the longitudinal member is defined by a hole.

8. The device of claim 1, wherein the swivel-coupling is disposed at a fixed length from the instrument, the fixed length being defined as the distance from the eyelets to the terminus section of the swivel end.

9. The device of claim 8, wherein the fixed length enables the swivel-coupling to be disposed approximately in an open space that forms between the instrument and the back of an instrument operator.

10. The device of claim 9, wherein the terminus section rotates up to 360 degrees and the body section remains substantially stationary when the instrument strap is twisting.

11. The device of claim 10, wherein the instrument includes at least one of the following: a guitar, an electric guitar, a string bass, a banjo, a mandolin, a marching drum, a brass instrument, a firearm, and a hand-held equipment.

12. The device of claim 11, further comprising a lanyard, the lanyard connecting the free end of the instrument strap and a section near the opposite end of the instrument strap.

13. The device of claim 12, wherein the belt clip detachably attaches to a belt worn by the instrument operator.

14. A swiveling strap extension device, the device comprising:

a flat, elongated longitudinal member comprising an instrument end and a swivel end, the instrument end defined by multiple spaced-apart eyelets, the eyelets being pliable, the swivel end having a terminus section and a body section, the body section being more proximal to the eyelets than the terminus section;

a belt clip detachably attached to the longitudinal member;

a swivel-coupling disposed between the terminus section and the body section of the swivel end, the swivel-coupling operable to swivel up to 360 degrees, whereby the terminus section of the swivel end rotates up to 360 degrees while the body section remains substantially stationary;

an instrument strap defined by a coupled end and a free end, the coupled end being coupled to an instrument, the free end being detachably attachable to the terminus section of the swivel end of the longitudinal member, whereby the swivel-coupling is disposed at a fixed length from the instrument, the fixed length being defined as the length from the eyelets to the terminus section of the swivel end, whereby the terminus section of the swivel end is operable to rotate up to 360 degrees in correlation with the swivel-coupling, while the body section of the swivel end and the instrument end of the longitudinal member remain substantially stationary; and a lanyard connecting the free end of the instrument strap and a section near the opposite end of the instrument strap.

15. A swiveling strap device, the device comprising:

a longitudinal member comprising an instrument end and a swivel end, the instrument end defined by multiple spaced-apart eyelets, the eyelets being pliable, at least one of the eyelets being coupled to a first end of an instrument, the swivel end of the longitudinal member being attached to a second end of the instrument;

a belt clip detachably attached to the longitudinal member and a belt worn by an operator of the instrument, the belt clip having two rotatable ends that enable 360 degree swiveling between the belt and the longitudinal member;

a swivel-coupling disposed between the instrument end and the swivel end, the swivel-coupling operable to swivel up to 360 degrees, whereby the swivel end rotates up to 360 degrees while the instrument end of the longitudinal member remain substantially stationary, the swivel-coupling being disposed at a fixed length from the instrument, the fixed length being defined as the length from the eyelets to the swivel end, whereby the fixed length enables the swivel-coupling to be disposed approximately in an open space that forms between the instrument and the body of an instrument operator;

an instrument strap defined by a coupled end and a free end, the coupled end being coupled to the instrument, the free end being detachably attachable to the swivel end of the longitudinal member.

16. The device of claim 15, wherein the first end of the instrument is a body of a guitar, and the second end of the instrument is a neck of the guitar.

17. The device of claim 15, further comprising a lanyard attached to the longitudinal member.

* * * * *